United States Patent [19]

St. Clair et al.

[11] 3,965,019

[45] June 22, 1976

[54] LUBRICATING COMPOSITIONS CONTAINING HYDROGENATED BLOCK COPOLYMERS AS VISCOSITY INDEX IMPROVERS

[75] Inventors: David J. St. Clair, Bethalto, Ill.; Ronald K. Crossland, Manhattan Beach, Calif.

[73] Assignee: Shell Oil Company, Houston, Tex.

[22] Filed: Dec. 19, 1974

[21] Appl. No.: 534,256

Related U.S. Application Data

[63] Continuation of Ser. No. 388,875, Aug. 16, 1973, abandoned.

[52] U.S. Cl. ..... 252/59

[51] Int. Cl.[2] ..... C10M 1/16

[58] Field of Search ..... 252/59

[56] References Cited

UNITED STATES PATENTS

| | | | |
|---|---|---|---|
| 3,554,911 | 1/1971 | Schiff et al. | 252/59 |
| 3,595,942 | 7/1971 | Wald et al. | 260/880 B |
| 3,630,905 | 12/1971 | Sorgo | 252/59 |
| 3,763,044 | 10/1973 | Anderson | 252/59 |
| 3,772,196 | 11/1973 | St. Clair et al. | 252/59 |
| 3,775,329 | 11/1973 | Eckert | 252/59 |
| 3,835,053 | 9/1974 | Meier et al. | 252/59 |

*Primary Examiner*—Delbert E. Gantz
*Assistant Examiner*—Andrew H. Metz
*Attorney, Agent, or Firm*—Dean F. Vance

[57] ABSTRACT

Lubricating compositions having improved operating life comprise lubricants containing hydrogenated polymers of conjugated dienes wherein at least 98% of the olefinic double bonds present in the non-hydrogenated precursors are reduced and at least 20% of the polymeric molecules contain no olefinic double bonds in the polymer backbone.

3 Claims, No Drawings

LUBRICATING COMPOSITIONS CONTAINING HYDROGENATED BLOCK COPOLYMERS AS VISCOSITY INDEX IMPROVERS

This application is a continuation of U.S. patent application Ser. No. 388,875, filed Aug. 16, 1973, now abandoned.

BACKGROUND OF THE INVENTION

A great variety of polymers have been utilized for modifying the properties of lubricating oils. Not only do these polymers increase the viscosity of the oil, but certain polymers will improve the viscosity index of the composition. This is becoming increasingly important as industry, particularly the automotive industry, makes more stringent demands for oils which will perform satisfactorily at both low and high temperature conditions. While many polymers, such as the polymethacrylates, are satisfactory for the production of multigrade oils such as 10W/30 and the like, the low temperature properties and shear stability properties of oils containing these polymers limit the utility of these polymers for multigrade oils having a wider applicability.

Hydrogenated polymers which have been used in the past include hydrogenated diene polymers, selectively hydrogenated random copolymers, and both selectively and completely hydrogenated block copolymers. These have been described at times as "substantially completely hydrogenated polymers." By this, the art has made the assumption that the hydrogenation of a defined class of double bonds such as olefinic double bonds was "essentially complete" when, actually less than 98% of the double bonds were reduced. With further investigation, however, it is becoming more evident that insofar as high levels of stability are concerned, this incomplete olefinic saturation is not completely satisfactory, especially under the influence of oxygen, high temperature and shear.

OBJECT OF THE INVENTION

It is an object of the invention to provide lubricating compositions containing improved polymers. It is a particular object of the invention to provide lubricating compositions having improved service life. Other objects will become apparent during the following detailed description of the invention.

STATEMENT OF THE INVENTION

Now, in accordance with the present invention, lubricants having prolonged operating life contain improved hydrogenated polymers of conjugated dienes in which at least 98% of the olefinic unsaturation present in the non-hydrogenated precursor polymers is reduced, and at least 20% of all polymer chains are free of olefinic double bonds in the backbone as measured by ozonolysis/gel permeation chromatography analysis.

For the purpose of describing the polymers of this invention, the high degree of saturation will be defined as a "saturation index." The saturation index can range from zero (every polymer molecule having at least one olefinic double bond in the backbone of the chain) to 100 (every polymeric molecule having no olefinic double bonds in the backbone of the chain). To more particularly describe the saturation index, the following standard test is proposed for the determination of the relative degree of backbone olefinic unsaturation (which excludes unsaturation in pendant radicals) remaining after hydrogenation:

A solution of a hydrogenated polymer of a conjugated diene (0.5g) in carbon disulfide (40cc) is subjected at −70°C to a mixed stream of ozone in oxygen (0.065SCFH) for five minutes. At this temperature, ozone does not react significantly with the saturated bonds within the time interval used, but ozone does react with essentially all of the olefinic double bonds.

The linkages formed by the reaction of ozone and olefinic bonds must then be cleaved, and the reducing agent triphenylphosphine is added for this purpose. The molecular weight changes are readily followed by GPC (gel permeation chromatography) analysis, and from GPC analysis of the polymer before and after ozonolysis, a saturation index, i.e. the percent remaining at the original polymer peak after ozonolysis, is determined. The sample for GPC analysis is prepared by evaporating a carbon disulfide from the ozonolysis sample and dissolving the polymer in tetrahydrofuran.

To permit as precise a determination as possible, a fixed concentration of an internal standard is added to all polymers, both reference and ozonized, before GPC analysis. Polystyrene of narrow molecular weight distribution and a molecular weight of approximately 6,000 is a satisfactory internal standard. For the purpose of calculations, it is necessary to measure the height of the polystyrene standard peak of both the reference polymer and the ozonolysis product GPC curves. The height and elution volume of the reference polymer peak are also measured. The height of the ozonolysis products peak must be measured at the elution volume of the reference polymer peak maximum, even though this will not generally be the maximum of the ozonolysis products peak. The saturation index is then calculaed by the use of the following equation:

$$\text{Saturation Index} = S_R/S_Z \times H_Z/H_R \times 100$$

where:

$S_R$ = reference polystyrene standard peak height
$S_Z$ = ozonolysis polystyrene standard peak height
$H_R$ = reference polymer peak height
$H_Z$ = ozonolysis products peak height Results are reproducible witin about 2 units and the percent of the peak retained is referred to hereinafter as saturation index.

In accordance with this invention it has been found that the saturation index of the subject hydrogenated polymers of conjugated dienes should be at least 20 and preferably at least 30, but these values depend on the resolving power of the GPC apparatus in use. For substances having about the same elution volumes as the polymers of this invention, the GPC was capable of essentially separating[1] two polymers of narrow molecular weight distribution if their molecular weights differed by a factor of 2.2.

[1] Two slightly overlapped peaks are defined as essentially separated if inflection tangents drawn through the overlapping peak sides intersect at the base line, which is the probable position of the GPC curve if neither peak had been present. This degree of resolving power will be incapable of detecting an unsaturated linkage close to the end of a long molecule because the change in molecular weight upon ozonolysis and cleavage will be insignificant. However, such a molecule would be expected to perform essentially as well as a completely saturated molecule, so the saturation index-performance correlation still holds.

The non-hydrogenated precursor polymers, from which the hydrogenated derivatives are prepared may comprise conjugated diene homopolymers or copolymers thereof with copolymerizable monomers, particularly a second diene or a monoalkenyl arene. The dienes especially contemplated, are butadiene and isoprene and the monoalkenyl arenes especially favored, are styrene, alpamethylstyrene and tert-butylstyrene as well as mixtures thereof. The polymers may be made of mixtures of two or more conjugated dienes or mixtures of conjugated dienes with one or more monoalkenyl arenes. They may be random copolymers, block copolymers, or tapered copolymers. The methods for making these various kinds of polymers are well known in the art; however, special preference is given to polymers prepared by solution methods and particularly to polymers prepared by the use of lithium based initiators especially lithium alkyls. While a molecular weight range is not critical in the operation of this invention in its generic sense, it is preferred that the polymers have average molecular weights between 20,000 and 200,000 since many commercial applications of these polymers utilize molecular weights within this general range. Suitable types of polymers are as follows:

Hydrogenated polyisoprene

Hydrogenated polybutadiene

Hydrogenated isoprene/butadiene random, tapered or block copolymers

Hydrogenated styrene/isoprene or styrene/butadiene random, tapered or block copolymers (styrene may be either hydrogenated or not)

Having prepared the polymers by methods known in the art, it is then necessary to hydrogenate them for the purpose of reducing the olefinic double bonds to the extent that at least 20%, and preferably at least 30%, of all of the polymers molecules are free from olefinic double bonds in the backbone.

The hydrogenation may be carried out preferably by highly active hydrogenation catalysts in the presence of a solvent for the polymer which is preferably inert to hydrogenation under the conditions employed. Suitable hydrogenation conditions for saturating up to about 98% of the olefinic double bonds will be found in U.S. Pat. No. 3,595,942. For the purpose of producing the still further degree of hydrogenation necessary to result in polymers having a saturation index of at least 20%, the hydrogenation conditions should be modified as follows:

The means by which high saturation index polymers are obtained is essentially that described in the U.S. patent referred to, care being taken to use a relatively high ratio of hydrogenation catalysts in the order of 1.5–5 mmole of nickel per liter of polymer solution. In other terms, the catalyst is present in an amount between 1 and 30 mmole of nickel per pound of polymer. The catalyst, which comprises the reduction product obtained by mixing an aluminum alkyl compound with a nickel or cobalt carboxylate preferably has a molar ratio of aluminum to nickel or cobalt between about 1.5 and 4.0. The hydrogenation is conducted for one to four hours (preferably 1.5–3 hours) at 20° to 120°C and under about 200 to 700 psi hydrogen pressure.

While the present invention is not to be restricted to any particular theory, it is tentatively postulated that the last and critical increment of hydrogenation is made difficult by steric hindrance due to some isomerization which may take place under hydrogenation conditions.

While general utility of the improved polymers is contemplated where maximum stability is desired, the important use of the subject high saturation index polymers is in the modification of lubricating oils. One of the difficult requirements to be met by premium multigrade lubricant is that the oil remain within the viscosity grades throughout its useful life, such as in an engine. Factors which influence the "stay-in-grade" property of a used motor oil are VI (viscosity index) improver degradation (oxidatively, thermally and due to shear). Other secondary influences include base oil thickening (due to oxidation), insolubles content (from blowby and oil oxidation products) and fuel dilution. The viscosity loss in the L-38 Oil Oxidation Test (Method No. 3405 of the Federal Test Method Series No. 791) is a widely accepted industry measure of the ability of compounded oils to remain within their oil viscosity grade. Polymers in which the saturation index is less than 20 exhibit a continual viscosity loss in the L-38 test, even though the polymers may have been hydrogenated to an extent of at least 98% of the olefinic double bonds. To determine the effect of saturation index on L-38 test results, two multigrade 10W/50 oils were run in the tests.

One petroleum lubricating oil was thickened with a block polymer having the structure polystyrene-hydrogenated polyisoprene (molecular weights of 32,000–55,000) whose saturation index was 2 (Oil A). A second oil was thickened with another polymer of the same structure and molecular weight which had been further hydrogenated to have a saturation index of 70 (Oil B). Both oils contained the same supplemental additive combination except that Oil A also contained an ashless rust inhibitor. The additive package was similar to those typically used in oils which meet requirements for API SE quality. The results obtained from running both of these polymer modified oils in the L-38 test are given in Table I below.

TABLE I

Viscosity at 210°F vs Operating Time in the L-38 Test

| Saturation Index<br>Operating Time, Hr. | Oil A<br>2<br>visc. at 210, SUS | Oil B<br>70<br>visc. at 210, SUS |
|---|---|---|
| New | 96.2 | 98.5 |
| 10 | 88.4 | 95.1 |
| 20 | 80.5 | 94.4 |
| 30 | 74.1 | 93.5 |
| 40 | 71.5 | 93.1 |
| 50 | 69.6 | — |
| 60 | 69.4 | — |

The results given in Table I show a remarkably smaller viscosity loss for Oil B, the oil containing the high saturation index polymer.

To investigate more fully the effect of saturation index on viscosity loss at 210°F in the L-38 test, a series of oils thickened with the same type of polymer having various saturation index values were tested. The polymers had the configuration polystyrene-hydrogenated polyisoprene, the block molecular weights being 30,000–50,000. (Where in the present specification and claims, reference is made to "hydrogenated diene polymers" or the like, this will mean polymers in which at least about 98% of the olefinic unsaturation of the non-hydrogenated precursor polymers has been reduced by hydrogenation.) All oils contain the same supplemental additive combination and all meet requirements of API SE quality. Results shown in Table II indicate that there is a strong correlation between viscosity loss at 210°F in the L-38 test and the saturation index of the polymer.

TABLE II

Viscosity vs Test Time in L-38 For Oils Containing Various Saturaton Index Polystyrene-Hydrogenated Polyisoprene block Polymers (Segmental Molecular Weights of: 30M–50M)

| Sample | Saturation Index of Polymer | | Test Time, Hours 0 | .25 | 2 | 10 | 30 | 40 | 60 |
|---|---|---|---|---|---|---|---|---|---|
| A | 3 | visc. 210,SUS | 106.7 | 103.6 | 101.0 | 96.5 | 87.3 | 84.7 | 80.7 |
| | | visc. 100,SUS | 692 | 670 | 672 | 645 | 572 | 551 | 520 |
| | | VI | 184 | 182 | 175 | 170 | 164 | 163 | 159 |
| E | 20 | visc. 210,SUS | 103.4 | 106.7 | 103.6 | 104.1 | 99.3 | 97.9 | 94.6 |
| | | visc. 100,SUS | 704 | 733 | 705 | 694 | 674 | 659 | 635 |
| | | VI | 185 | 174 | 173 | 177 | 172 | 171 | 168 |
| C | 27 | visc. 210,SUS | 105.4 | 106.2 | 108.8 | 104.9 | 101.0 | 98.5 | 94.1 |
| | | visc. 100,SUS | 704 | 692 | 698 | 686 | 676 | 657 | 632 |
| | | VI | 185 | 187 | 187 | 181 | 174 | 173 | 168 |
| D | 40 | visc. 210,SUS | 104.9 | 103.6 | 99.4 | 100.6 | 97.7 | 97.1 | 93.6 |
| | | visc. 100,SUS | 681 | 671 | 661 | 675 | 654 | 650 | 631 |
| | | VI | 182 | 182 | 174 | 174 | 173 | 171 | 167 |
| E | 51 | visc. 210,SUS | 103.6 | 102.8 | 103.2 | 101.4 | 99.3 | 98.4 | 96.5 |
| | | visc. 100,SUS | 669 | 667 | 667 | 670 | 658 | 646 | 639 |
| | | VI | 182 | 178 | 179 | 177 | 175 | 175 | 173 |

The above data demonstrate that there is a significant improvement in performance of a lubricant containing a polymer with a saturation index of 20 over a lubricant containing a polymer with a saturation index of 3. The performance improvement of a polymer with a saturation index of 50 over one with an index of 20 is substantial, and the performance of the lubricant containing a polymer with an index of 70 (Table I) was exceptional.

The lubricating composition of the present invention may comprise low, medium or high viscosity index petroleum hydrocarbon lubricants although high or very high VI oils are preferred. The oils may contain any of the commercially available lubricating oil additives known in the art and particular reference is made to pour point depressants, normally required in multigrade oils, since they encounter low operating temperatures. Rust inhibitors, antioxidants, detergents and other well-known additives may be utilized in addition to the thickening polymers of this invention.

The compositions of this invention may contain from about 0.1 to 10% by weight of high saturation index polymer, although for normal applications the polymer will be present in amounts between about 0.25 and 4.5% by weight based on the total lubricant composition.

What is claimed is:

1. A lubricating composition comprising a major proportion of a petroleum lubricating oil and from about 0.1% to about 10% by weight of a selectively hydrogenated block copolymer having the structure polystyrene-hydrogenated polyisoprene wherein at least 98% of the olefinic double bonds present in the non-hydrogenated precursor of said polymer are reduced by hydrogenation, at least 20% of the polymer chains containing no in-chain olefinic unsaturation.

2. A composition according to claim 1 wherein at least 50% of the polymeric chains contain no in-chain olefinic unsaturation.

3. A composition according to claim 1 wherein at least 70% of the polymeric chains contain no in-chain olefinic unsaturation.

* * * * *